United States Patent [19]

Mori

[11] Patent Number: 4,694,807

[45] Date of Patent: Sep. 22, 1987

[54] FUEL INJECTION CONTROL SYSTEM FOR INTERNAL COMBUSTION ENGINE WITH ASYNCHRONOUS FUEL INJECTION FOR FUEL SUPPLY RESUMPTION FOLLOWING TEMPORARY FUEL CUT-OFF

[75] Inventor: Yasushi Mori, Yokohama, Japan

[73] Assignee: Nissan Motor Company, Limited, Yokohama, Japan

[21] Appl. No.: 737,940

[22] Filed: May 28, 1985

[30] Foreign Application Priority Data

May 29, 1984 [JP] Japan ..... 59-107588

[51] Int. Cl.[4] ..... F02M 39/00

[52] U.S. Cl. ..... 123/501; 123/357; 123/198 DB; 123/493

[58] Field of Search ..... 123/493, 501, 500, 357, 123/358, 359, 198 DB

[56] References Cited

U.S. PATENT DOCUMENTS

| | | | |
|---|---|---|---|
| 4,485,791 | 12/1984 | Sugo | 123/501 |
| 4,589,391 | 5/1986 | Sieber | 123/501 |
| 4,592,327 | 6/1986 | Fujimori | 123/501 |

FOREIGN PATENT DOCUMENTS

| | | | |
|---|---|---|---|
| 58-163740 | 9/1983 | Japan | 123/501 |
| 59-49339 | 3/1984 | Japan | 123/501 |
| 59-51137 | 3/1984 | Japan | 123/501 |
| 59-90728 | 5/1984 | Japan | 123/501 |

*Primary Examiner*—Carl Stuart Miller

*Attorney, Agent, or Firm*—Schwartz, Jeffery, Schwaab, Mack, Blumenthal & Evans

[57] ABSTRACT

In a fuel injection control system which cuts off the fuel supply under certain zero-engine-load conditions, a single asynchronous fuel injection is performed immediately in response to a fuel resumption request. Fuel resumption is ordered when, for example, a throttle valve opens from its idling position or when engine speed drops too low. The single asynchronous fuel injection is performed immediately and with an enhanced fuel quantity to ensure prompt and adequate response to changing engine conditions. Normal, synchronous fuel injection timing is adjusted following fuel resumption to match, or at least not to interfere with, the timing of the asynchronous fuel injection.

25 Claims, 10 Drawing Figures

START
1302
Sth = 1 ?
NO
YES
1304
FC = 1 ?
NO
YES
1306
N > Nref ?
YES
YES
1314
N > Nc ?
NO
1322
FC = 1 ?
YES
NO
NO
1308
Qf ← 2Qf
1318
FC = 1
1320
Qf = 0
1310
OUTPUT RESUME SIGNAL
1324
READ θr
1326
OUTPUT D2
1312
FC = 0
RETURN

FUEL INJECTION CONTROL SYSTEM FOR INTERNAL COMBUSTION ENGINE WITH ASYNCHRONOUS FUEL INJECTION FOR FUEL SUPPLY RESUMPTION FOLLOWING TEMPORARY FUEL CUT-OFF

BACKGROUND OF THE INVENTION

The present invention relates generally to a fuel injection control system for an internal combustion engine which temporarily cuts off the fuel supply under negligible engine load conditions. More specifically, the invention relates to fuel injection timing control upon resumption of the fuel supply after temporary fuel cut-off.

Japanese Patent First Publications Nos. 59-49339, 59-51137 and 59-90728, respectively published on Mar. 21, 1984, Mar. 24, 1984 and May 25, 1984 disclose acceleration enrichment during engine speed acceleration by way of asynchronous fuel injection. In such fuel injection control systems, the fuel injection amount for acceleration enrichment is so derived that the air/fuel mixture does not change abruptly.

On the other hand, Japanese Patent First Publication No. 58-163740, published on Sept. 28, 1983 discloses a fuel injection system which performs asynchronous fuel injection for fuel recovery after temporary fuel cut-off. In the shown system, the fuel injection amount in the asynchronous injection and subsequent synchronous injection are so derived that the total amount of the injected fuel in a asynchronous injection and in the immediately subsequent synchronous injection covers the fuel demand for engine speed recovery after fuel cut-off.

In this system, fuel injection amount during asynchronous injection alone is not sufficient for fuel supply resumption. Therefore, in a period between the asynchronous injection and the subsequent synchronous injection, the air/fuel mixture will become too lean to allow combustion in the engine cylinder. As a result, response to fuel supply resumption may be delayed by as much as 120°. This clearly degrades engine performance and may even result in engine stalling if the engine speed should change too abruptly, as may occur during abrupt deceleration of the vehicle.

One possible solution would be to increase the fuel injection amount for asynchronous injection during fuel supply resumption. However, in this case, the air/fuel mixture would tend to be too rich in the subsequent synchronous injection. This would result in unnecessary increases in fuel consumption, and would be generally undesirable in view of air pollution by exhaust.

SUMMARY OF THE INVENTION

Therefore, it is an object of the present invention to provide a fuel injection control system which has good response to fuel supply resumption after temporary fuel cut-off.

Another object of the invention is to provide a fuel injection control system with variable fuel injection timing resettable depending upon fuel supply resumption timing.

A further object of the invention is to provide a fuel injection control system which, after temporary fuel cut-off, resumes asynchronous injection with fuel injection amount sufficient to reinstitute combustion in the engine but not so large as to create an excessively rich air/fuel mixture rate.

In order to accomplish the aforementioned and other objects, a fuel injection control system, according to the present invention, resumes asynchronous injection with fuel enrichment. After a single asynchronous injection, timing of subsequent synchronous injection may be adjusted in accordance with the fuel resumption timing.

According to one aspect of the invention, a fuel injection control system comprises a first sensor producing a first sensor signal representative of the angular position of the crank shaft, a second sensor producing a second sensor signal representative of preselected engine operating parameters, a third sensor detecting whether engine operating conditions satisfy a predetermined fuel cut-off condition and if so, producing a third sensor signal, fourth means for deriving a fuel injection amount on the basis of the second sensor signal value and producing a fuel injection control signal having a value indicative of the derived fuel injection amount, fifth means for disabling the fourth means in the presence of the third sensor signal and for resumption operation of the fourth means after the third sensor signal ends, the fifth means modifying the fuel injection signal value to a given degree for the first fuel injection upon resumption of the operation of the fourth means, and sixth means for deriving fuel injection timing and producing an injection timing control signal, the sixth means normally deriving the fuel injection timing on the basis of the first sensor signal so as to perform fuel injection at a predetermined angular position of the crank shaft, and producing the injection timing signal independently of the crank shaft angular position upon termination of the third sensor signal.

According to another aspect of the invention, a fuel injection control system comprises a first sensor producing a first sensor signal representative of the angular position of the crank shaft, a second sensor producing a second sensor signal representative of preselected engine operating parameters, a third sensor detecting whether engine operating conditions satisfy a predetermined fuel cut-off condition and if so, producing a third sensor signal, fourth means for deriving a fuel injection amount on the basis of the second sensor signal value and producing a fuel injection control signal having a value indicative of the derived fuel injection amount, fifth means for disabling the fourth means in response to the third sensor signal and for resumption operation of the fourth means after the third sensor signal ends, and sixth means for deriving fuel injection timing and producing a injection timing control signal, the sixth means normally deriving the fuel injection timing on the basis of the first sensor signal so as to perform fuel injection at a predetermined angular position of the crank shaft, and producing a injection timing signal independent of the crank shaft angular position in response to termination of the third sensor signal, and the sixth means again deriving the fuel injection timing on the basis of the first sensor signal after outputting one injection timing signal independent of the first sensor signal.

According to a further aspect of the invention, a method for controlling fuel resumption after fuel cut-off comprises the steps of:

monitoring crank shaft rotation and producing a crank reference signal at predetermined angular positions of the crank shaft and a crank position signal after each predetermined unit of crank shaft rotation;

monitoring engine operating conditions including engine load and engine revolution speed and producing an engine operating condition signal;

deriving fuel injection amount on the basis of the engine operating condition signal;

deriving fuel injection timing on the basis of the crank reference signal and the crank position signal;

detecting whether the engine operating condition signal satisfies a predetermined fuel cut-off condition and if so, producing a fuel cut-off demand signal;

performing fuel-cut off in response to the fuel cut-off demand signal;

detecting whether the engine operating condition signal satisfies a predetermined fuel resumption condition during after fuel cut-off and if so, producing a fuel resumption demand signal;

deriving a modified fuel injection amount in response to the fuel resumption demand signal;

performing fuel injection of the modified fuel injection amount at a timing independent of the crank reference signal and the crank position signal in response to the fuel resumption demand signal; and performing fuel injection timing of the first-mentioned fuel injection amount at the timing derived from the crank reference signal and the crank position signal in the absence of the fuel cut-off demand signal and the fuel resumption demand signal.

BRIEF DESCRIPTION OF THE DRAWINGS

The present invention will be understood more fully from the detailed description given herebelow and from the accompanying drawings of the preferred embodiments of the invention, which, however, should not be taken to limit the invention to the specific embodiments but are for explanation and understanding only.

In the drawings.

DESCRIPTION OF THE PREFERRED EMBODIMENT OF THE INVENTION

Figure 1:
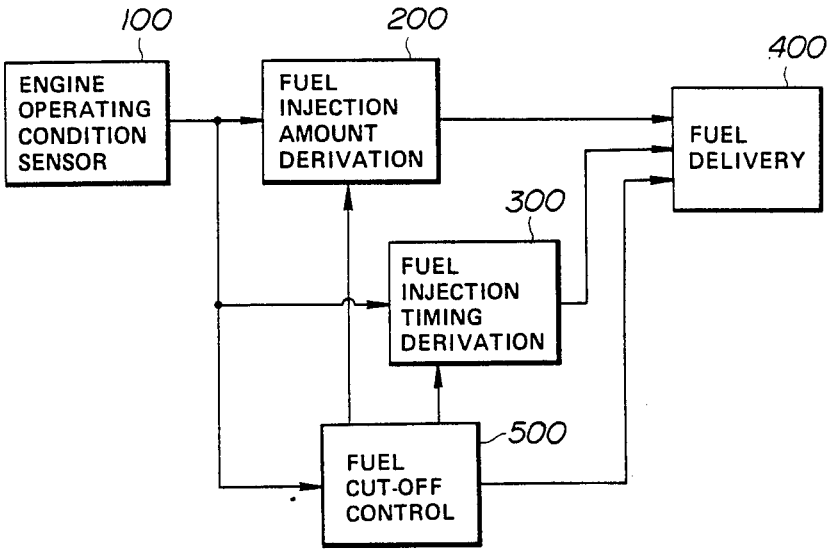
FIG. 1 is a schematic block diagram of a fuel injection control system according to the present invention, illustrating the fundamental principles behind the invention.

Referring now to the drawings, particularly to FIG. 1, a fuel injection control system according to the present invention includes an engine operating condition sensor 100 which monitors engine operating conditions and produces a fuel injection control parameter signal. The engine operating condition sensor in practice includes various sensors including a crank angle sensor, an intake air flow sensor, a throttle valve switch and so forth. A fuel injection amount derivation means 200 receives the fuel injection control parameter signals and derives a fuel injection amount on the basis of the fuel injection control parameter signal values, in a per se well-known manner. In general, the fuel injection amount derivation means 200 derives a basic fuel injection amount $T_p$ on the basis of engine speed N and engine load Q which can be represented by intake air flow rate $Q_a$. The basic fuel injection amount $T_p$ is corrected on the basis of known correction parameters, such as engine coolant temperature, oxygen concentration in the exhaust, throttle valve angular position and so forth. Correction of the basic fuel injection amount on the basis of selected correction parameters has been disclosed in U.S. Pat. No. 4,319,327 to K. Higashiyama et al and commonly assigned to the common owner. The contents of this U.S. Patent are also incorporated by reference for the sake of disclosure.

It should be noted that, although the following disclosure neglects the feature of correction of the basic fuel injection amount in order to simplify the disclosure, derivation of the fuel injection amount may be interpreted to include such corrections to the basic fuel injection amount.

A fuel injection timing derivation means 300 also receives the fuel injection control parameter signal from the engine operating condition sensor means 100. In general, fuel injection is performed in synchronism with the engine revolution cycle. The fuel injection timing derivation means 300 may also mediate asynchronous fuel injection under certain engine operating conditions such as in response to abrupt increases in engine load and so forth. For example, U.S. Pat. No. 4,459,670 to Hiroshi YAMAGUCHI discloses initiation of asynchronous fuel injection when engine load increases at a rate exceeding a given value. The contents of the above-identified U.S. Patent are hereby incorporated by reference for the sake of disclosure.

A fuel cut-off control means 500 generally controls fuel cut-off under zero-engine-load conditions and predetermined fuel cut-off conditions. In most cases, the zero-engine-load state is recognized by detecting when the throttle valve open angle is less than a zero-load condition threshold or when the throttle valve is essentially closed. On the other hand, fuel injection resumes when the engine speed drops below a predetermined engine speed in order to prevent the engine from stalling. In order to control fuel cut-off, the fuel injection control means refers to a fuel cut-off threshold and a fuel resumption threshold. In order to prevent hunting in the fuel cut-off control, the fuel cut-off threshold is set higher than the fuel resumption threshold. This method of controlling fuel cut-off has been disclosed in the copending U.S. patent application Ser. No. 402,951, filed on Sept. 21, 1982. The contents of the aforementioned U.S. Patent application is herein incorporated by reference for the sake of disclosure.

The fuel injection amount derivation means 200, the fuel injection timing derivation means 300 and the fuel cut-off control means 500 are associated with a fuel delivery means 400 which includes one or more fuel injection valves for injecting an amount of fuel derived by the fuel injection amount derivation means 200 at a timing derived by the fuel injection timing derivation means 300. The fuel delivery means 400 also includes a driver circuit for actuating the fuel injection valves. The driver circuit produces a driver signal in the form of a pulse signal, the pulse width of which defines the valve open period and thus defines the fuel injection amount to be delivered to the induction system of the engine. Derivation of the duration of the driver signal pulses has been disclosed in U.S. Pat. No. 4,502,446 (82226), to H. Kanegae et al. The contents of the above-identified U.S. Patent is herein incorporated by reference for the sake of disclosure.

According to the present invention, the fuel-cut-off control means 500 responds to signals from the engine operating condition sensor indicative of closure of the throttle valve, i.e. of zero-engine-load conditions, by comparing the engine speed input from the engine operating condition sensor means 100 with the fuel cut-off threshold $N_c$. The fuel supply is cut off if the throttle valve is essentially closed and the engine speed is higher than the fuel cut-off threshold. While the fuel supply is cut off, the fuel cut-off control means 500 monitors changes in the engine speed and compares the engine speed with the fuel resumption threshold $N_r$ which is set lower than the fuel cut-off threshold $N_c$ so as to provide some hysteresis in fuel cut-off control.

In the fuel cut-off state, the fuel cut-off control means inputs a fuel cut-off state indicative signal to the fuel injection amount derivation means 200 ordering the latter to set the fuel injection amount to zero. On the other hand, when fuel supply is to be resumed, the fuel cut-off control means 500 outputs a resume signal to the fuel injection amount derivation system to enable fuel injection amount calculation on the basis of the fuel injection control parameters from the engine operating condition sensor means 100. The fuel injection amount derivation means 200 responds to the resume signal by augmenting the fuel injection amount derived on the basis of the fuel injection control parameter, which process will be referred to hereafter as "fuel resumption enrichment". At the same time, the resume signal from the fuel cut-off control means 500 is sent to to the fuel injection timing derivation means 300. The fuel injection timing derivation means responds to the resume signal by producing a fuel injection timing signal independent of the crankshaft angular position. The resume signal is also sent to the fuel delivery means 400, and the first fuel injection takes place immediately upon receipt of the resume signal. The first fuel injection after fuel cut-off irrelative of the crank angle position will be referred to hereafter as "asynchronous resumption injection".

After the asynchronous resumption injection, the fuel injection amount derivation means 200 and the fuel injection timing derivation means 300 return to normal operation.

The present invention as generally disclosed above will be disclosed in greater detail in terms of the preferred embodiments of the invention hereafter.

Figure 2:
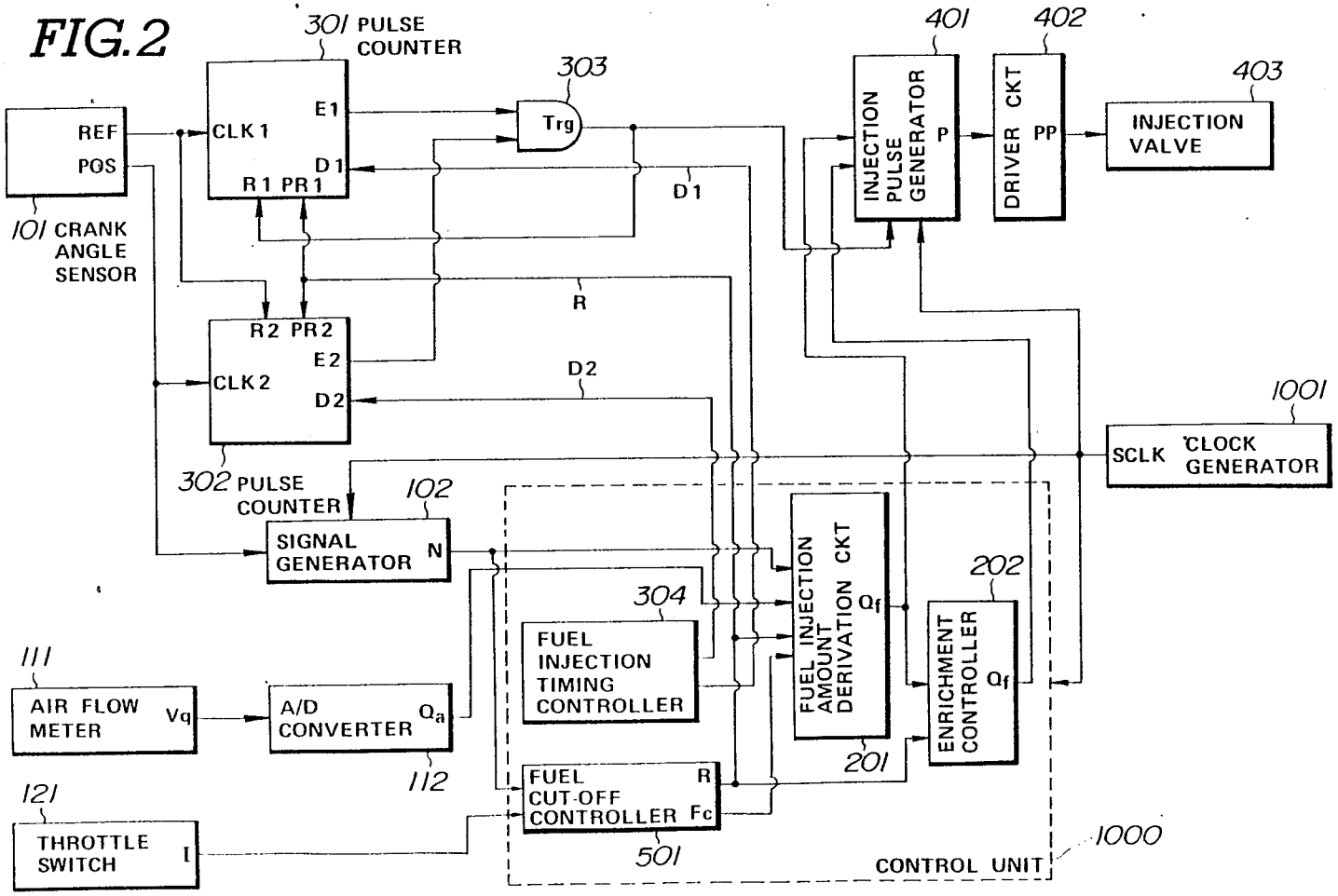
FIG. 2 is a block diagram of the first embodiment of the fuel injection control system according to the invention.

FIG. 2 shows the first embodiment of the fuel injection control system according to the present inventiom. In this embodiment, the engine condition sensor means 100 generally comprises a crank angle sensor 101, an intake air flow meter 111 and a throttle switch 121. The crank angle sensor 101 is per se well known and produces a crank reference position signal $S_{ref}$ at predetermined crank shaft angular positions, and a crank position signal $S_{pos}$ after a predetermined extent of crank shaft rotation, e.g. 1° or 2°. In the shown embodiment, the crank reference signal $S_{ref}$ is produced after every 120° of crank shaft rotation, and the crank position signal is produced after every 2° of crank shaft rotation.

The crank position signal $S_{pos}$ is supplied to an engine speed signal generator 102. The engine speed signal generator 102 is also connected for input from a system clock generator 1001. The engine speed signal generator 102 counts the crank position signal pulses $S_{pos}$ over the period between clock pulses from the system clock generator and outputs the count as an engine speed signal $S_N$.

The air flow meter 111 produces an analog air flow rate signal $V_g$ with a voltage level corresponding to the air flow rate in the induction system of the engine. The analog air flow rate signal $V_g$ is output to an analog-to-digital (A/D) converter 112.

The engine speed signal $S_N$ and an air flow rate signal $S_{Qa}$ derived by analog/digital conversion of the analog air flow rate signal $V_g$ are input to a control unit 1000. The control unit 1000 comprises a fuel injection amount derivation circuit 201, an enrichment controller 202, a fuel injection timing controller 304 and a fuel cut-off controller 501. The fuel injection amount derivation circuit 201 receives the engine speed signal $S_N$ and the air flow rate signal $S_{Qa}$ and derives the fuel injection amount $Q_f$ on the basis thereof.

The fuel injection timing controller 303 selects a fuel injection timing in relation to the crank shaft angular position. In the shown embodiment, fuel injection is performed in each cycle of crank shaft revolution. Since this system is designed for use in a 4-cycle, 6-cylinder engine, the crank reference signal $S_{ref}$ is produced after every 120° of crank shaft rotation. Therefore, the system performs fuel injection once for every three crank reference position signal pulses $S_{ref}$. In addition, the system refers to a predetermined advance angle from the crank shaft reference position with respect to which the fuel injection timing is measured. For instance, assuming that fuel injection is to be timed relative to the top dead centers of the No. 1 and No. 4 cylinder, fuel injection is in fact performed at a given angle, e.g. 10° to 20°, in advance of the top dead center of the No. 1 and No. 4 cylinder. In order to select the fuel injection timing, the fuel injection timing controller 304 sets a crank reference position value $D_1$, i.e. 3, and an advance angle value $D_2$. The fuel injection timing controller 304 is connected for output to pulse counters 301 and 302. The pulse counter 301 is set with the crank position value $D_1$ and the pulse counter 302 is set with the advance angle value $D_2$.

The pulse counter 301 is also connected for input from the crank angle sensor 101 to count the crank reference position signal pulses $S_{ref}$. The pulse counter 301 outputs a HIGH-level counter signal E1 when the counter value $CLK_1$ reaches the set value $D_1$.

The pulse counter 302 is also connected for input from the crank angle sensor 101 to count the crank position signal pulses $S_{pos}$. The pulse counter 302 starts counting the crank position signal pulses $S_{pos}$ in response to the crank reference position signal $S_{ref}$ and produces a HIGH-level counter signal E2 when the counter value $CLK_2$ reaches the set value $D_2$.

The pulse counters 301 and 302 are connected for output to an AND gate 303. When the AND gate 303 receives HIGH-level counter signals from both pulse counters 301 and 302, its outputs a HIGH-level gate signal Trg. This HIGH-level gate signal Trg serves as a trigger signal for an injection pulse generator 401. The injection pulse generator 401 is triggered by the leading edge of the HIGH-level gate signal Trg from the AND gate 303 to output a HIGH-level signal P to the driver circuit 402.

The gate signal Trg from the AND gate 303 is also supplied to the reset terminal of the pulse counter 301 to reset the latter.

The injection pulse generator 401 is also connected for input from the fuel injection amount derivation circuit 201 and the enrichment controller 202 to receive two possibly differing fuel injection amount signals. The injection pulse generator 401 is also connected to the system clock generator 1001 to receive clock signal pulses. A modified fuel injection amount signal $Q_f'$ from the enrichment controller 202 specifies the pulse width of the injection pulse produced by the injection pulse generator 401. The injection pulse generator 401 counts clock pulses from the system clock generator and compares the counter value with the fuel injection amount signal $Q_f$. When the counter value reaches the fuel injection amount signal value $Q_f$, the injection pulse generator 401 terminates its HIGH-level output. The driver circuit 402 sends a drive signal to the fuel injection valve over the period during which the fuel injection pulse from the injection pulse generator 401 remains HIGH.

The fuel cut-off controller 501 receives the engine speed signal N from the engine speed signal generator 102 and a throttle position signal T from the throttle switch 121. In general, the fuel cut-off controller 501 cuts off the fuel supply when both the engine speed is higher than the fuel cut-off threshold and the throttle valve is substantially closed. On the other hand, the fuel cut-off controller 501 decides to resume fuel supply when the engine speed drops below a fuel resumption threshold. Therefore, the fuel cut-off controller 501 is responsive to a HIGH-level throttle position signal I from the throttle switch 121, which indicates that the throttle valve is substantially closed, to compare the engine speed signal value N to the fuel cut-off threshold $N_c$. If the engine speed signal value N is then greater than the fuel cut-off threshold $N_c$, the fuel cut-off controller 501 outputs a fuel cut signal Fc. The fuel cut signal Fc is sent to the fuel injection amount derivation circuit 201. The fuel injection amount derivation circuit 201 respond to the fuel cut signal Fc by setting its output value to zero. This prevents the injection pulse generatos 401 from producing any more injection pulses. In other words, the fuel supply is cut off.

On the other hand, when the engine speed signal value N drops below the fuel resumption threshold $N_r$ while the fuel supply is cut off, or when the throttle position indicative signal $S_{th}$ turns LOW as the throttle valve opens, the fuel cut-off controller 501 decides to resume fuel supply and accordingly produces a resume signal R. The resume signal R is supplied to the fuel injection amount derivation circuit 201, the enrichment controller 202 and the pulse counters 301 and 302. The fuel injection amount derivation circuit 201 is responsive to the resume signal R to restart calculation of the fuel injection amount on the basis of the engine speed signal value N and the intake air flow rate signal $S_{Qa}$ and to output the fuel injection amount signal $Q_f$ representative of the derived fuel injection amount. The enrichment controller 202 receives the fuel injection amount signal from the fuel injection amount derivation circuit 201 and modify the signal value $Q_f$ so as to order air/fuel mixture enrichment in response to the resume signal R. In practice, the enrichment controller 202 outputs a modified fuel injection amount signal $Q_f$ having a value twice as large as the fuel injection amount signal value $Q_f$ in the presence of the resume signal R, and equal thereto otherwise. The injection pulse generator 401 is set by the output $Q_f'$ of the enrichment controller 202.

At the same time, the pulse counters 301 and 302 respond to the resume signal R by accepting new, current counter values at $D_1$ and $D_2$ respectively. This satisfies the AND condition of the AND gate 303 immediately. Therefore, the AND gate outputs a HIGH-level gate signal to the injection pulse generator 401 to trigger the latter.

Figure 3:
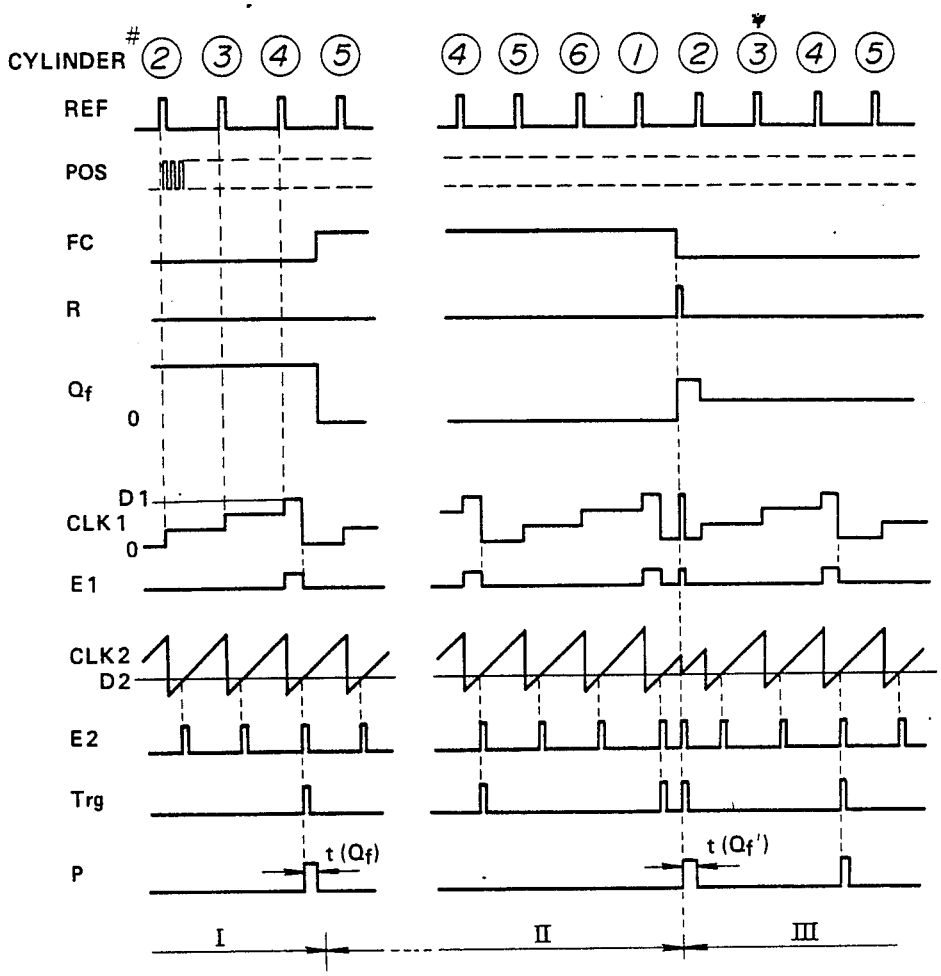

The operation of the first embodiment of the fuel injection control system according to the invention will be described with reference to FIGS. 3 and 4. In FIG. 3, normal fuel injection control is performed over the period labelled "1". As set forth above, the pulse counter 301 counts the crank reference position signal $S_{ref}$ and outputs a HIGH-level counter signal E1 when its counter value become equal to the set value $D_1$. On the other hand, the pulse counter 302 produces the a HIGH-level counter signal E2 when its counter value $CLK_2$ become equal to the set value $D_2$. As will be seen from FIG. 3, the AND condition of the AND gate 303 is thus established after every third HIGH-level counter signal E2 from the pulse counter 302. Therefore, at that timing, the HIGH-level gate signal Trg is output to injection pulse generator 401. The HIGH-level gate signal Trg is send to the injection pulse generator 401 to trigger the latter and to the pulse counter 301 to reset the counter value thereof.

The injection pulse generator 401 responds to the leading edge of the HIGH-level gate signal Trg by outputting an injection pulse having a pulse width t corresponding to the modified fuel injection amount signal value $Q_f'$ in this case, equal to $Q_f$. Therefore, the fuel injection valve 403 is opened for the period defined by the fuel injection pulse p from the fuel injection pulse generator 401.

During the above normal operation, if the throttle valve should be closed for engine braking or while coasting, the fuel cut-off controller 501 becomes active. If at the same time, the engine speed signal value N is greater than the fuel cut-off threshold $N_c$, the fuel cut-off controller 501 outputs the fuel cut-off signal Fc. In response to the fuel cut-off signal Fc, the fuel injection amount derivation circuit 201 starts to output the fuel injection amount signal $Q_f$ indicative of a zero fuel injection amount. This causes the injection pulse generator 401 to stop outputting the fuel injection pulses P. As a result, the fuel injection valve 403 is held closed during the period II in FIG. 3.

During the period II throughout which the fuel supply is cut off, the pulse counters 301 and 302 continue to output HIGH-level signals E1, E2 whenever their counter values $CLK_1$ and $CLK_2$ reach the corresponding set values $D_1$ and $D_2$. At predetermined angular positions of the crank shaft, the HIGH-level gate signal Trg is output to trigger the injection pulse generator 401. Therefore, the injection pulse generator 401 is still triggered at predetermined angular positions of the crank shaft. However, at this time, since the pulse width defined by the modified fuel injection amount indicative signal value $Q_f'$ is zero, no fuel injection pulses p will be output.

Due to the cut-off of the fuel supply, the engine speed N starts to drop. When the engine speed N drops below the fuel resumption threshold $N_r$ or if the throttle valve should open again, the fuel cut-off condition will no longer be satisfied. The fuel cut-off controller 501 then outputs the resume signal R (at the beginning of the period III of FIG. 3. In the example shown in FIG. 3, the request for fuel resumption occurs some time after the crank reference position signal $S_{pos}$ indicative of the top dead center of the No. 1 cylinder, which matches the fuel injection timing before fuel cut-off in the range II.)

In response to the resume signal R from the fuel cut-off controller 501, calculation of the fuel injection amount $Q_f$ by the fuel injection amount derivation circuit 201 on the basis of the engine speed signal value N and the intake air flow rate signal value $Q_a$ is resumed. At the same time, the enrichment controller 202 becomes active in response to the resume signal R. The enrichment controller 202 modifies the fuel injection amount signal value $Q_f$ to twice its normal value $Q_f$. As shown in FIG. 3, the enrichment controller 202 remains active for a predetermined period of time over which it holds the output value of the injection pulse generator 401 at twice the normal fuel injection amount signal value $Q_f$.

In addition, in response to the resume signal R, the pulse counters 301 and 302 are preset to the set values $D_1$ and $D_2$. Therefore, the gate signal Trg immediately goes HIGH to trigger the injection pulse generator 401 to perform asynchronous injection. As set forth above, since the modified fuel injection amount indicative signal $Q_f'$ is modified for fuel resumption enrichment, the fuel injection pulse width will be twice as long as the fuel injection pulse width defined by the fuel injection amount signal $Q_f$ of the fuel injection amount determination circuit 201.

The pulse counter 301 is cleared by the HIGH-level gate signal Trg of the AND gate 303. Thus, after fuel resumption fuel injection is performed after every group of a given number, i.e. 3, of crank reference position signal pulses, advanced in accordance with the set value $D_2$ of the pulse counter 302. In the example shown in FIG. 3, since the asynchronous injection takes place after the top dead center of the No. 1 cylinder, the second fuel injection takes place near the top dead center of the No. 4 cylinder. Therefore, in the example shown in FIG. 3, fuel injection after fuel resumption is performed near the TDC positions of the No. 1 and No. 4 cylinders, which is the same timing as before fuel cut-off.

Figure 4:
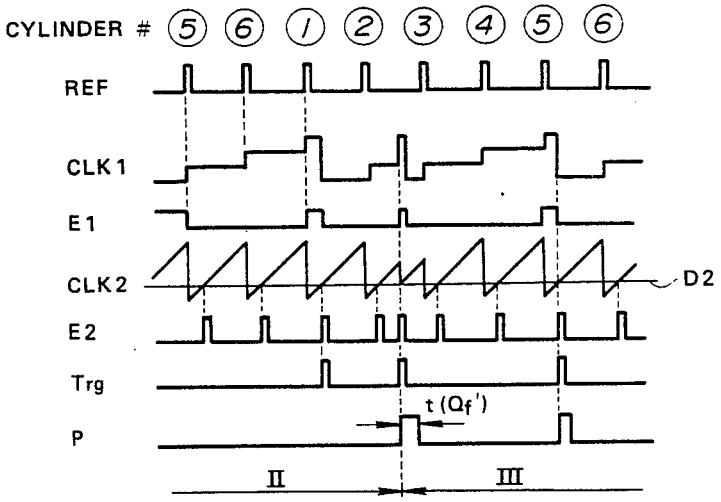
FIGS. 3 and 4 are timing charts for the signals produced in the first embodiment of the fuel injection system of FIG. 2.

On the other hand, in the example shown in FIG. 4, the fuel resumption demand occurs after the top dead center of the No. 2 cylinder. In the case of FIG. 4, asynchronous resumption injection takes place in the crank shaft angular position range in which the No. 2 cylinder is in its combustion stroke and No. 3 cylinder is in its compression stroke. Therefore, the counter value $CLK_1$ of the pulse counter 301 becomes equal to one in response to the crank reference position signal $S_{ref}$ representative of the top dead center of the No. 3 cylinder. The counter value $CLK_1$ reaches the set value $D_1$, i.e. 3, near the top dead center of the No. 5 cylinder as shown in FIG. 4. Therefore, the second fuel injection takes place near the top dead center of the No. 5 cylinder. Consequently, subsequent fuel injections take place near the top dead center positions of the No. 2 and No. 5 cylinders.

Therefore, according to the shown embodiment, fuel injection timing is variable in accordance with the fuel resumption timing. This successfully prevents the initial air/fuel mixture from becoming too rich, as might otherwise occur, and ensures the fastest possible response to the fuel resumption request.

Figure 5:
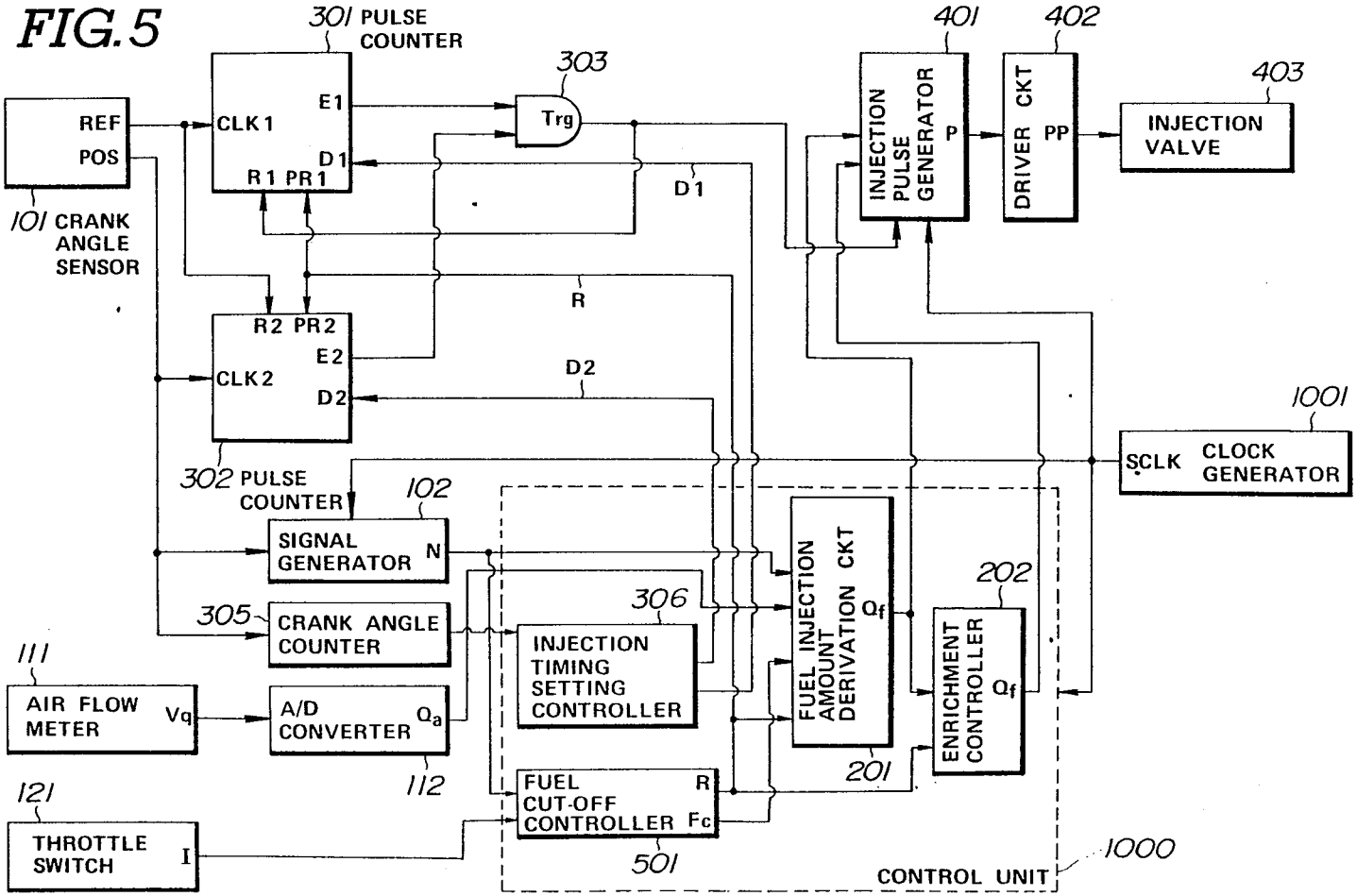
FIG. 5 is a block diagram of the second embodiment of the fuel injection control system according to the invention.

FIG. 5 shows the second embodiment of the fuel injection control system according to the invention. In this embodiment, components common to those of the first embodiment are labelled with the same reference numerals and explanation in detail is left out for clarity.

In this embodiment, a crank angle counter 305 is added to the first embodiment of FIG. 2. Also, the fuel injection timing controller 304 of the first embodiment is replaced by a fuel injection timing setting circuit 306.

The crank angle counter 305 is connected for input from the crank angle sensor 101 and counts the crank angular position signal pulses $S_{pos}$. The crank angle counter 305 counts the crank position signal pulses up to 120° and resets its counter value to zero when it reaches 120°.

Although the shown embodiment employs a crank angle counter 305 which resets its counter value to zero automatically when it reaches 120°, it would also be possible to reset the counter 305 in response to the crank reference position signal.

Figure 6:
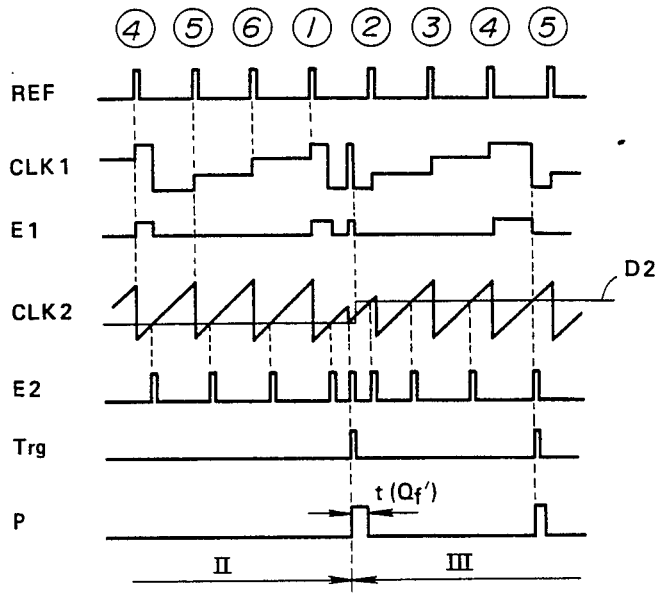
FIG. 6 is a timing chart for the signals produced in the second embodiment of the fuel injection control system of FIG. 5.

The crank angle counter 305 outputs a crank angle count which varies over the range of 0° to 120°. The crank angle count is sent to the fuel injection timing setting circuit 306. The injection timing setting circuit 306 responds to the resume signal R by latching the crank angle count for use as an updated preset value $D_2$. The injection timing setting circuit 306 then sets the pulse counter 302 to the updated preset value $D_2$. Therefore, according to the present invention, after asynchronous resumption injection, fuel injection takes place subsequently after every 360° of crank shaft rotation, as shown in FIG. 6.

Figure 7:
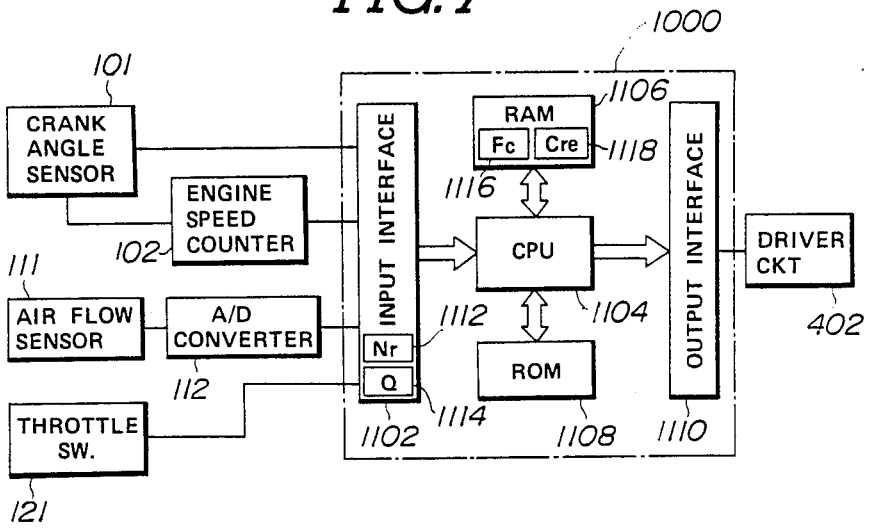
FIG. 7 is a block diagram of the third embodiment of the fuel injection control system according to the invention.
Figure 8:
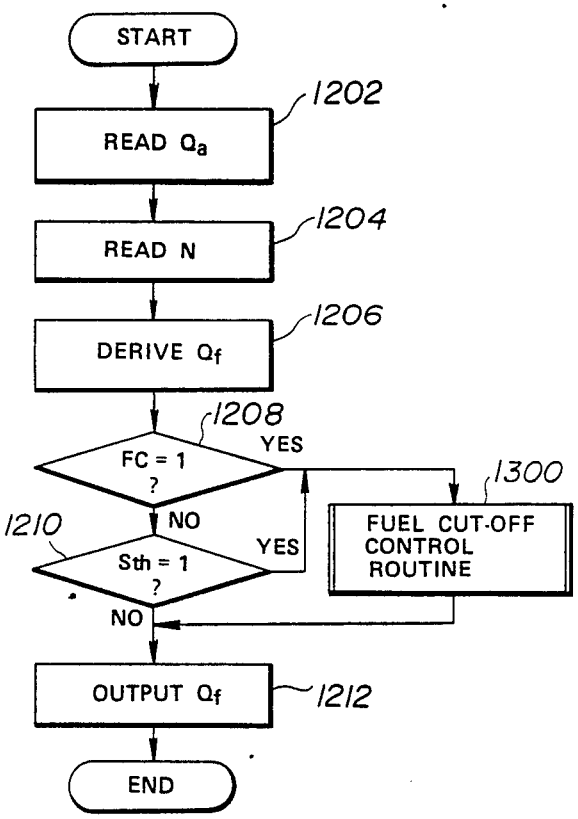
FIG. 8 is a fuel injection amount deriving program executed by the control unit in the third embodiment of FIG. 7.
Figure 9:
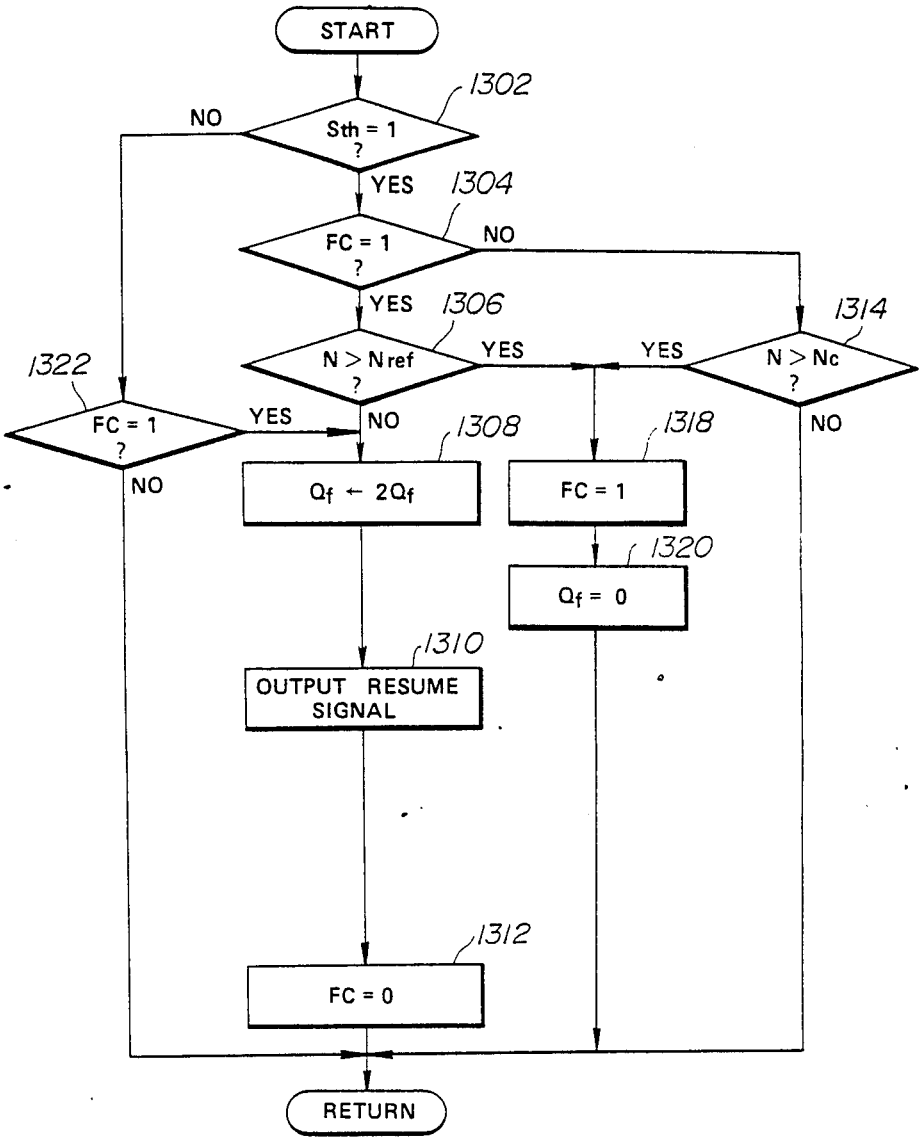
FIG. 9 is a flowchart of a fuel cut-off control routine executed By the control unit in thethird embodiment of FIG. 7.

FIGS. 7 to 9 show the third embodiment of the fuel injection control system according to the invention. In this third embodiment, a microprocessor is employed to perform the fuel injection control operations essentially as described with reference to the first and second embodiments.

The controller 1000 of the shown embodiment comprises a microprocessor including an input interface 1102, CPU 1104, RAM 1106, ROM 1108 and output interface 1110. The input interface is provided with temporary registers 1112 and 1114 for temporarily storing the engine speed value Nr and the intake air flow rate value Q. RAM 1106 has a memory block 1116 serving as a flag register for a fuel cut-off state indicative flag Fc, and another memory block 1118 serving as counters for the crank reference position signal pulses $S_{ref}$ and for the crank position signal pulses $S_{pos}$ for use in deriving the trigger timing of the fuel injection control programs of FIGS. 8 and 9.

FIG. 8 shows a main control program executed at a predetermined crank shaft angular position, i.e. every 360°. The trigger timing of the main control program may be considered to be substantially the same as the trigger timing of the injection pulse generator in the first embodiment.

After starting execution, the intake air rate value Q is read out from the temporary register 1114 in the input interface at a block 1202. The engine speed value N is read out from the temporarily register 1112 at a block 1204. After this, fuel injection amount $Q_f$ is derived on the basis of the intake air flow rate Q and the engine speed N, at a block 1206. In the block 1206, if desired, any modification of the fuel injection amount derived on the basis of the intake air flow rate Q and the engine speed N with known correction factors may be performed.

After the fuel injection amount derivation at the block 1206, the fuel cut-off state flag Fc is checked to see whether or not it is set, at a block 1208. If the fuel cut-off state flag Fc is not set when checked to the block 1208, then the throttle position signal $S_{th}$ is checked to see whether or not it is HIGH, at a block 1210. If the throttle position signal $S_{th}$ is at its LOW level, then the fuel injection control signal indicative of the fuel injection amount $Q_f$ is output at a block 1212.

On other hand, if the fuel cut-off state flag Fc is set when checked at the block 1208 or the throttle position signal $S_{th}$ is HIGH, then control passes to a block 1300 in which a fuel cut-off control routine as shown in FIG. 9 is executed.

As will be appreciated from the above, the routine of FIG. 9 is triggered when the fuel cut-off state flag Fc is set or the throttle position signal $S_{th}$ is HIGH. After starting execution, the throttle position signal $S_{th}$ is again checked at a block 1302. If the throttle position signal $S_{th}$ is high when checked at the block 1302, then the fuel cut-off flag Fc is again checked at a block 1304. If flag Fc is set, the engine speed N is compared with the fuel resumption threshold Nr at a block 1306. If the engine speed N is equal to or lower than the fuel resumption threshold Nr, the fuel injection amount $Q_f$ derived at the block 1206 of the main control program is modified to $2Q_f$ for resumption enrichment at a block 1308. Then, the resume signal R is output in a block 1310 to enable the driver circuit 402. Finally, the fuel cut-off state indicative flag Fc is reset at a block 1312.

If the fuel cut-off flag Fc is not set when checked at the block 1304, then control passes to a block 1314 in which the engine speed N is compared to the fuel cut-off threshold Nc. If the engine speed N is equal to or lower than the fuel cut-off threshold Nc, then control returns immediately to the main program shown in FIG. 8.

If the engine speed N exceeds the fuel resumption threshold Nr when checked at the block 1306, or if the engine speed N exceeds the fuel cut-off threshold Nc when checked at the block 1314, then control passes to a block 1318 in which the fuel cut-off state flag Fc is set. After this, the fuel injection amount $Q_f$ derived at the block 1206 is reset to zero at a block 1320 to induce a total fuel supply cut-off. If the throttle position indicative signal $S_{th}$ is low when checked at the block 1302, the routine goes to a block 1322. In block 1322, the fuel cut-off flag Fc is is again checked and if it is not set, control returns immediately to the main program. Otherwise, i.e. if the throttle valve opens after fuel cut-off, control passes to the blocks 1308, 1310 and 1322 for fuel resumption.

As will be appreciated herefrom, this third embodiment operates in essentially the same manner as does the previous embodiments.

Figure 10:
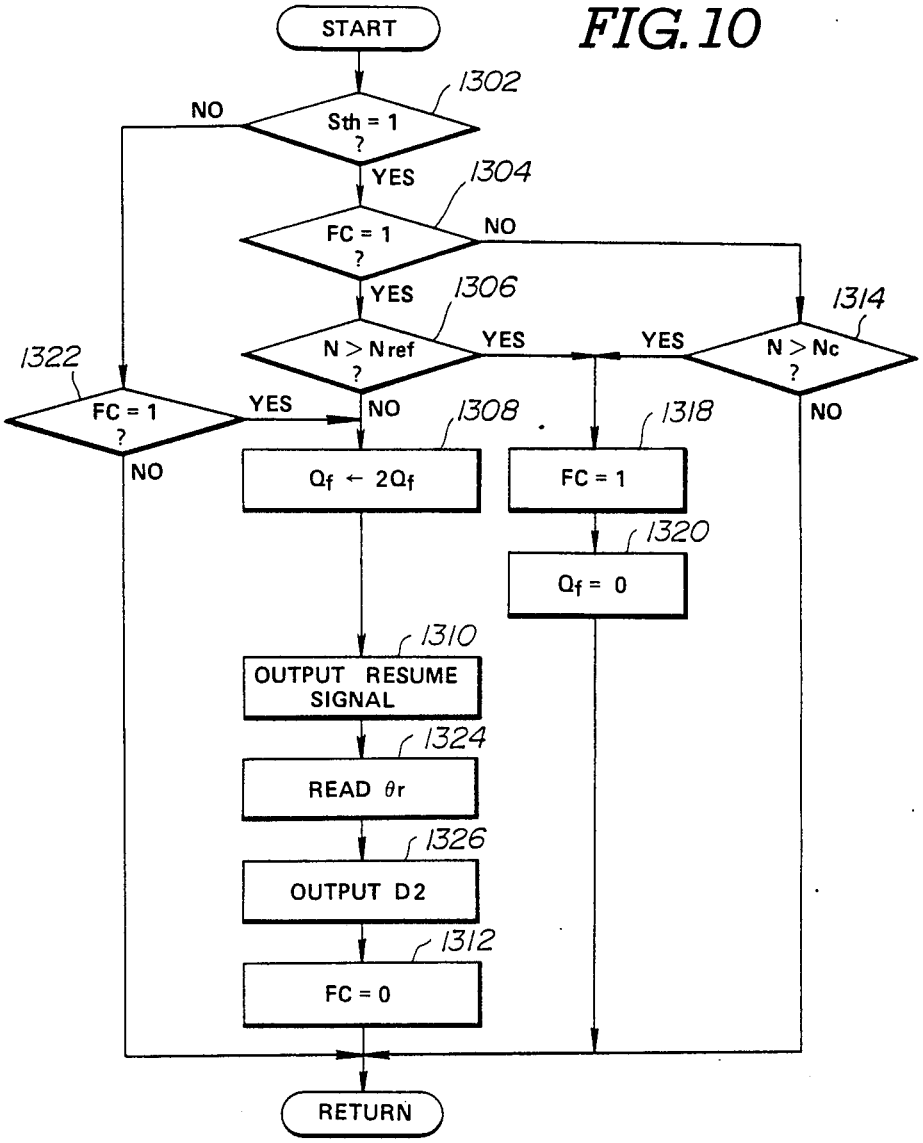
FIG. 10 is a flowchart of a modified fuel cut-off control routine executed by the control unit of FIG. 7.

FIG. 10 shows a modification to the fuel cut-off control routine of FIG. 9.

In the modification of FIG. 10, blocks 1324, and 1326 are added to the routine of FIG. 9. In the block 1324 following block 1310, the crank angle counter value Cr in the crank angle counter 1118 is latched. The value latched at the block 1324, replaces the previous trigger factor value $D_2$ at the block 1326. Therefore, as in the second embodiment, fuel injection subsequent to fuel resumption is performed at a crank reference position specified by the fuel supply resumption timing.

As set forth above, the present invention fulfills all of the objects and advantages sought therefor.

While the present invention has been illustrated in terms of the preferred embodiments, the invention should not be understood as being limited to any of the preferred embodiments. The invention should be appreciated to include all possible modifications and embodiments derived from the appended claims without departing from the principle of the invention.

What is claimed is:

1. A fuel injection control system for an internal combustion engine comprising:

a first sensor producing a first sensor signal representative of the angular position of the crank shaft;

a second sensor producing a second sensor signal representative of preselected engine operating parameters;

a third sensor detecting whether engine operating conditions satisfy a predetermined fuel cut-off condition and if so, producing a third sensor signal;

fourth means for deriving a fuel injection amount on the basis of a value of said second sensor signal and producing a fuel injection control signal having a value indicative of the derived fuel injection amount;

fifth means for disabling said fourth means in the presence of said third sensor signal and for resumption operation of said fourth means after said third sensor signal ends, said fifth means modifying said fuel injection signal value to a given degree for the first fuel injection upon resumption of the operation of said fourth means;

sixth means for deriving fuel injection timing and producing an injection timing control signal, said sixth means normally deriving said fuel injection timing on the basis of said first sensor signal so as to perform fuel injection at a predetermined angular position of said crank shaft, and producing said injection timing signal independently of the crank shaft angular position upon termination of said third sensor signal, and wherein said first sensor signal includes a first pulse train representative of predetermined angular positions of said crank shaft and a second pulse train representative of predetermined units of rotation of the crank shaft, and said sixth means counts the pulses of said first and second pulse trains, produces said injection timing signal when a first counter value of said first pulses reaches a given value and a second counter value of said second pulses reaches a second given value, and presets said first and second counter values to said first and second value in response to said third sensor signal.

2. The fuel injection control system as set forth in claim 1, wherein said sixth means resets said first counter value to zero in response to said injection timing signal and resets said second counter value to zero in response to each pulse of said first pulse train.

3. The fuel injection control system as set forth in claim 2, wherein said sixth means latches said second counter value in response to the trailing edge of said third sensor signal and then updates said second given value with the latched value.

4. The fuel injection control system as set forth in claim 3, wherein said sixth means produces a predetermined number of said injection timing signals during each crank shaft rotation, and said fourth means derives said fuel injection amount for each fuel injection in such a manner that total amount of fuel injected over said predetermined number of fuel injections satisfies a fuel demand for each engine cylinder derived from said second sensor signal value.

5. The fuel injection control system as set forth in claim 4, wherein said fifth means increases said fuel injection amount derived by said fourth means in response to the trailing edge of said third signal so that the fuel injection amount to be injected by the first fuel injection after resumption of operation of said fourth means is increased to the amount sufficient for taking place combustion.

6. A fuel injection control system for an internal combustion engine comprising:

a first sensor producing a first sensor signal representative of the angular position of the crank shaft;

a second sensor producing a second sensor signal representative of preselected engine operating parameters;

a third sensor detecting whether engine operating conditions satisfy a predetermined fuel cut-off condition and if so, producing a third sensor signal;

fourth means for deriving a fuel injection amount on the basis of said second sensor signal value and producing a fuel injection control signal having a value indicative of the derived fuel injection amount;

fifth means for disabling said fourth means in response to said third sensor signal and for resumption operation of said fourth means after said third sensor signal ends; and sixth means for deriving fuel injection timing and producing a injection timing control signal, said sixth means normally deriving said fuel injection timing on the basis of said first sensor signal so as to perform fuel injection at a predetermined angular position of said crank shaft, and producing a injection timing signal independent of the crank shaft angular position in response to termination of said third sensor signal, and said sixth means again deriving said fuel injection timing on the basis of said first sensor signal after outputting one injection timing signal independent of said first sensor signal.

7. The fuel injection control system as set forth in claim 6, wherein said sixth means produces a predetermined number of said injection timing signals within each crank shaft rotation, and said fourth means derives said fuel injection amount for each fuel injection in such a manner that the total amount of fuel injected over said predetermined number of fuel injections satisfies a fuel demand for each engine cylinder derived from said second sensor signal value.

8. The fuel injection control system as set forth in claim 7, wherein said fifth means increases said fuel injection amount derived by said fourth means in response to the trailing edge of said third signal in such a manner that the fuel amount injected in the first injection after resumption operation of said fourth means is increased to satisfy the fuel demand derived from said second sensor signal value.

9. The fuel injection control system as set forth in claim 8, wherein said sixth means updates said predetermined angular position of said crank shaft upon resumption of fuel injection in accordance with the timing of termination of said third sensor signal.

10. The fuel injection control system as set forth in claim 6, wherein said first sensor signal includes a first pulse train representative of predetermined angular positions of said crank shaft and a second pulse train representative of predetermined units of rotation of the crank shaft, and said sixth means counts the pulses of said first and second pulse trains, produces said injection timing signal when a first counter value of said first pulses reaches a given value and a second counter value of said second pulses reaches a second given value, and presets said first and second counter values to said first and second value in response to said third sensor signal.

11. The fuel injection control system as set forth in claim 10, wherein said sixth means resets said first counter value to zero in response to said injection timing signal and resets said second counter value to zero in response to each pulse of said first pulse train.

12. The fuel injection control system as set forth in claim 11, wherein said sixth means latches said second counter value in response to the trailing edge of said third sensor signal and then updates said second given value with the latched value.

13. The fuel injection control system as set forth in claim 12, wherein said sixth means produces a predetermined number of said injection timing signals during each crank shaft rotation, and said fourth means derives said fuel injection amount for each fuel injection in such a manner that total amount of fuel injected over said predetermined number of fuel injections satisfies a fuel demand for each engine cylinder derived from said second sensor signal value.

14. The fuel injection control system as set forth in claim 13, wherein said fifth means increases said fuel injection amount derived by said fourth means in response to the trailing edge of said third signal so that the fuel injection amount to be injected by the first fuel injection after resumption of operation of said fourth means is increased to satisfy the fuel demand derived from said second sensor signal value.

15. A method for controlling fuel cut-off in a fuel injection internal combustion engine comprising the steps of:

monitoring crank shaft rotation and producing a crank reference signal at predetermined angular positions of said crank shaft and a crank position signal after each predetermined unit of crank shaft rotation;

monitoring engine operating conditions including engine load and engine revolution speed and producing an engine operating condition signal;

deriving fuel injection amount on the basis of said engine operating condition signal;

deriving fuel injection timing on the basis of said crank reference signal and said crank position signal;

detecting whether said engine operating condition signal satisfies a predetermined fuel cut-off condition and if so, producing a fuel cut-off demand signal;

performing fuel-cut off in response to said fuel cut-off demand signal;

detecting whether said engine operating condition signal satisfies a predetermined fuel resumption condition during after fuel cut-off and if so, producing a fuel resumption demand signal;

deriving a modified fuel injection amount in response to said fuel resumption demand signal;

performing fuel injection of the modified fuel injection amount at a timing independent of said crank reference signal and said crank position signal in response to said fuel resumption demand signal; and performing fuel injection timing of the first-mentioned fuel injection amount at the timing derived from said crank reference signal and said crank position signal in the absence of the fuel cut-off demand signal and the fuel resumption demand signal.

16. The method as set forth in claim 15, in which predetermined number of fuel injections are performed within each engine revolution cycle, and said fuel injection amount for each fuel injection is derived such that the total amount of fuel injected over said predetermined number of fuel injections satisfies a fuel demand for each engine cylinder derived from said engine operating condition signal value.

17. The method as set forth in claim 16, wherein said fuel injection amount derived in response to said fuel resumption demand signal is determined so as to satisfy the fuel demand derived from said engine operating condition signal value.

18. The method as set forth in claim 17, wherein said fuel injection timing derived on the basis of the crank shaft angular position varies in accordance with the timing of said fuel resumption demand signal.

19. The method as set forth in claim 15, wherein said fuel injection timing is derived by counting pulses of said crank reference signal and of said crank position signal, and fuel injection is normally performed when a first counter value of said crank reference signal pulses reaches a given value and a second counter value of said crank position signal pulses reaches a second given value.

20. The method as set forth in claim 19, wherein said first and second counter values are set to said first and second given values in response to said fuel resumption demand signal so as to induce fuel injection independent of the crank shaft angular position.

21. The method as set forth in claim 20, wherein said first counter value is reset to zero in response to fuel injection and said second counter value is reset to zero in response to each pulse of said crank reference signal.

22. The method as set forth in claim 21, wherein said second counter value is latched in response to said fuel resumption demand signal and thereafter used as said second given value.

23. A fuel injection control system for an internal combustion engine comprising:

a first sensor producing a first sensor signal representative of the angular position of the crank shaft;

a second sensor producing a second sensor signal representative of preselected engine operating parameters;

a third sensor detecting whether engine operating conditions satisfy a predetermined fuel cut-off condition and if so, producing a third sensor signal;

fourth means for deriving a fuel injection amount on the basis of a value of said second sensor signal and producing a fuel injection control signal having a value indicative of the derived fuel injection amount;

fifth means for disabling said fourth means in the presence of said third sensor signal and for resumption operation of said fourth means after said third sensor signal ends, said fifth means modifying said fuel injection signal value to a given degree for the first fuel injection upon resumption of the operation of said fourth means;

sixth means for deriving fuel injection timing and producing an injection timing control signal, said sixth means normally deriving said fuel injection timing on the basis of said first sensor signal so as to perform fuel injection at a predetermined angular position of said crank shaft, and producing said injection timing signal independently of the crank shaft angular position upon termination of said third sensor signal, and wherein said sixth means again signals fuel injection at said predetermined angular position of said crank shaft after once outputting an injection timing signal independent of said first sensor signal.

24. A fuel injection control system for an internal combustion engine comprising:

a first sensor producing a first sensor signal representative of the angular position of the crank shaft;

a second sensor producing a second sensor signal representative of preselected engine operating parameters;

a third sensor detecting whether engine operating conditions satisfy a predetermined fuel cut-off condition and if so, producing a third sensor signal;

fourth means for deriving a fuel injection amount on the basis of a value of said second sensor signal and producing a fuel injection control signal having a value indicative of the derived fuel injection amount;

fifth means for disabling said fourth means in the presence of said third sensor signal and for resumption operation of said fourth means after said third sensor signal ends, said fifth means modifying said fuel injection signal value to a given degree for the first fuel injection upon resumption of the operation of said fourth means;

sixth means for deriving fuel injection timing and producing an injection timing control signal, said sixth means normally deriving said fuel injection timing on the basis of said first sensor signal so as to perform fuel injection at a predetermined angular position of said crank shaft, and producing said injection timing signal independently of the crank shaft angular position upon termination of said third sensor signal, and wherein said sixth means updates said predetermined angular position of said crank shaft upon resumption of fuel injection in accordance with the timing of termination of said third sensor signal.

25. A fuel injection control system for an internal combustion engine comprising:

a first sensor producing a first sensor signal representative of the angular position of the crank shaft;

a second sensor producing a second sensor signal representative of preselected engine operating parameters including an intake air flow rate and an engine speed;

a third sensor detecting whether engine operating conditions satisfy a predetermined fuel cut-off condition and if so producing a third sensor signal;

fourth means for deriving a fuel injection amount on the basis of said intake air flow rate and said engine speed as indicated by said second sensor signal and for producing a fuel injection control signal having a value indicative of the derived fuel injection amount;

fifth means for disabling said fourth means in the presence of said third sensor signal and for resuming operation of said fourth means after said third sensor signal ends, said fifth means modifying said fuel injection signal value to a given degree for the first fuel injection upon resumption of the operation of said fourth means; and sixth means for deriving fuel injection timing and producing an injection timing control signal, said sixth means normally deriving said fuel injection timing on the basis of said first sensor signal so as to perform fuel injection at a predetermined angular position of said crank shaft, and producing said injection timing signal independently of the crank shaft angular position upon termination of said third sensor signal.

* * * * *